US005359159A

United States Patent [19]

Gommel

[11] Patent Number: 5,359,159

[45] Date of Patent: Oct. 25, 1994

[54] INTERNAL COMBUSTION ENGINE

[75] Inventor: Reinhard Gommel, Backnang, Fed. Rep. of Germany

[73] Assignee: Firma Andreas Stihl, Waiblingen, Fed. Rep. of Germany

[21] Appl. No.: 192,136

[22] Filed: Feb. 4, 1994

[30] Foreign Application Priority Data

Feb. 4, 1993 [DE] Fed. Rep. of Germany ..... 4303127

[51] Int. Cl.[5] ..... F01N 3/02; F02B 33/04

[52] U.S. Cl. ..... 181/230; 181/240; 123/73 R; 123/74 R

[58] Field of Search ..... 781/230, 231, 232, 229, 781/240, 243; 123/41.65, 41.70, 73 R, 74 R

[56] References Cited

U.S. PATENT DOCUMENTS 4,370,855 2/1983 Tuggle ..... 181/240 X

FOREIGN PATENT DOCUMENTS 76008 8/1993 Fed. Rep. of Germany .

1453635 10/1976 United Kingdom .

*Primary Examiner*—Michael L. Gellner

*Assistant Examiner*—Khanh Dang

*Attorney, Agent, or Firm*—Robert W. Becker & Associates

[57] ABSTRACT

An internal combustion engine has a crankcase and a cylinder with an outlet with a first flange. A muffler having an inlet with a second flange is connected to the outlet with the inlet. The muffler is formed as a unitary part. The first flange has a first flange surface and the second flange has a second flange surface, whereby the first flange surface and the second flange surface contact one another so as to form a flange connection. At least two slip-on clamps are connected to a circumference of the flange connection. The clamp has substantially the shape of a bracket with two legs extending in the same direction. The legs have inner surfaces facing one another. The flange connection has receiving surfaces for the legs wherein the inner surfaces of the legs cooperate with the receiving surfaces so as to force the first and the second flange surfaces against one another. Internal combustion engines with a muffler connected in the described manner are especially suitable for hand-held working tools such as motor chain saws.

20 Claims, 3 Drawing Sheets

INTERNAL COMBUSTION ENGINE

Background of the Invention

This invention relates to an internal combustion engine having a crankcase and a cylinder as well as a muffler in the form of a unitary part which is connected to the outlet of the cylinder, whereby the outlet of the cylinder and the inlet of the muffler each have a flange surface and wherein means for securing are provided in the area of the flange connection.

From British patent 1 453 635 a connection of an exhaust pipe with a cylinder of an internal combustion engine is known wherein the exhaust pipe, the so-called exhaust manifold, is a unitary part and wherein the inlet openings of the exhaust pipe and the outlets of the cylinders are connected to one another by flanges. The flange surfaces of the exhaust pipe and the cylinder are positioned closely adjacent to one another, and at the cylinder pawl-like securing means are provided which engage clamp-like over the flanges at the exhaust pipe and hold them securely. For such an arrangement it is necessary that the flange connection is easily accessible and tools for mounting the fastening means must be usable. Such a space requirement and the accessibility of the flange connection cannot be provided for hand-held working tools such as for example motor chain saws. Furthermore, in the known arrangement the manufacture of threaded bores and the screwing of securing elements is required which is unfavorable with respect to space and cost considerations.

It is furthermore known from German patent 76 008 to provide a pipe connection in which the flanges are provided with a radial collar. Over the circumference of the collar a plurality of clamp-like elements are arranged which are prestressed with a clamping device such that the two pipe ends are tightly held together. The clamping device for the clamps must be tensioned with tools.

It is an object of the present invention to improve an internal combustion engine of the aforementioned kind such that for a muffler cast in a unitary construction the mounting is simplified, safer and more cost efficient.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
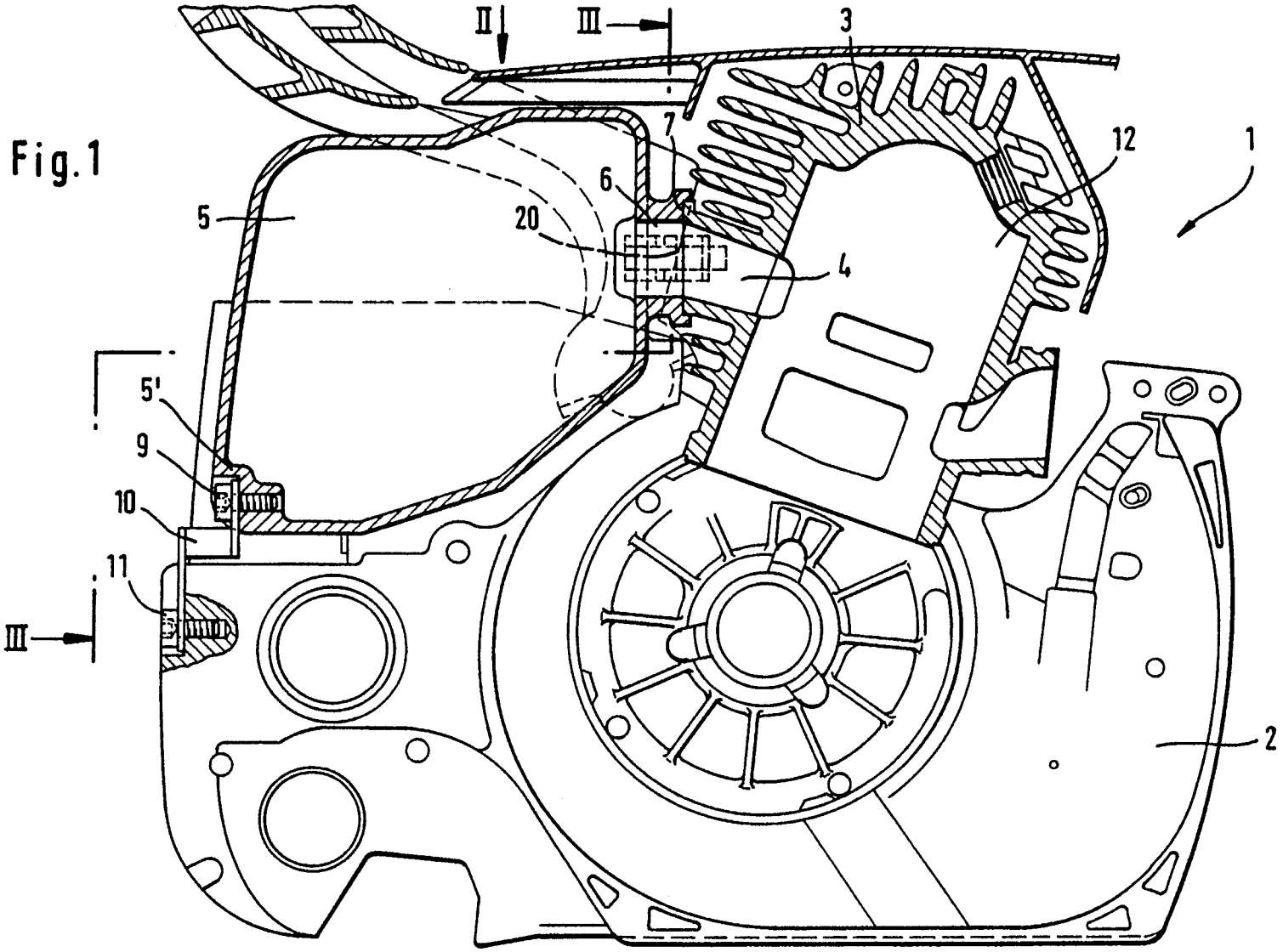
FIG. 1 shows an internal combustion engine with muffler.

The internal combustion engine according to the present invention is primarily characterized by:

A crank case;

A cylinder with an outlet;

A muffler having an inlet and connected with the inlet to the outlet of the cylinder, the muffler formed as a unitary part;

The outlet having a first flange surface and the inlet having a second flange surface, the first flange surface and the second flange surface contacting one another so as to form a flange connection;

At least two slip-on clamps connected to a circumference of the flange connection;

The clamp having substantially the shape of a bracket with two legs extending in a same direction;

The legs having inner surface facing one another;

The flange connection having receiving surfaces for the legs wherein the inner surfaces of the legs cooperate with the receiving surfaces so as to force the first and the second flange surfaces against one another.

Preferably, the receiving surfaces extend at a slant angle of less than 15° relative to the first and the second flange surfaces. Preferably the slant angle is substantially 8°.

According to a preferred embodiment of the present invention, the receiving surfaces are formed by a radial collar at the outlet and a radial collar at the inlet. Expediently, one of the radial collars at the outlet and the inlet has an axial step and the other of the radial collars at the outlet and the inlet has an edge. The step engages over the edge.

In an advantageous embodiment of the present invention, the receiving surfaces are in the form of radial projections of the first and the second flange surfaces, wherein the radial projections of the first flange surface are positioned congruent to the projections of the second flange surface. Expediently, one of the radial projections has an axial step and the other of the radial projections has an edge, whereby the step engages over the edge.

Advantageously, the at least two clamps are uniformly distributed over the circumference of the flange connection.

The legs preferably extend parallel to one another and the clamp has a stay connecting the legs, whereby the stay extends perpendicular to the legs.

Expediently, the inner surfaces of the legs at free ends of the legs have a slanted portion with an opening angle of less than 15° and the receiving surfaces extend at a slant angle relative to the first and the second flange surfaces. The slant angle is preferably identical to the opening angle. Advantageously, the slant angle and the opening angle are substantially 8°.

Preferably, the length of the inner surface of the legs is substantially identical to a distance between the legs. Preferably the internal combustion engine further comprises a means for securing the clamp in a defined position. The means is preferably a spring bracket that exerts a permanent prestress onto the clamp. Preferably, for two clamps that are positioned diametrically opposite one another the means is in the form of one common spring bracket. The two clamps then each have a depression in the stay. The spring bracket has free ends that rest in these depressions.

Preferably, the spring bracket consists of a wire having at substantially half its length an expansion section. Advantageously, the muffler has an end remote from the flange connection and further comprises auxiliary fastening elements for connecting the end remote from the flange connection to the crank case. The fastening elements are preferably screws and support brackets.

Preferably, the cylinder and the muffler are made of a material selected from the group of aluminum and aluminum alloys and the clamps are made of steel, preferably hardened steel.

The important advantages of the invention are that a unitary cast muffler can be connected in a simple manner securely at the outlet of the cylinder and, at the same time, a good support and thus sealing of the flange surfaces between the muffler and the cylinder, respectively, cylinders is achievable.

According to a preferred embodiment, the receiving surfaces for the legs of the clamp extend at an angle of less than 15°, preferably at an angle of approximately 8°, relative to the flange surface. With this measure it is achieved that by slipping the clamps onto the receiving surfaces an increasing clamping force and thus a self-clamping (self-locking) is generated. The receiving surfaces are expediently formed by a radial collar at the outlet of the cylinder and the inlet of the muffler. For such an embodiment the clamps can be positioned at any desired location at the circumference of the flange connection. When the position for the clamps is predetermined, it is sufficient that the receiving surfaces are provided in the form of radial projections at the flange surfaces whereby the projections at the outlet and the inlet are positioned congruent to one another. It is expedient in this context that the clamps are uniformly distributed over the circumference of the flange connection. In the case of only two clamps they should be positioned diametrically opposite to one another.

In order to achieve an exact positioning during mounting of the muffler at the cylinder and in order to prevent a displacement in the direction of the flange surfaces, it is expedient that at the collar or the radial projections of one of the flange surfaces an axial step is provided that engages over an edge of the abutting collar, respectively, the abutting radial projection. The clamps are preferably designed such that they have parallel extending legs that are connected to one another by a stay that extends perpendicularly to the longitudinal direction of the legs. In this context it has been proven advantageously to design the clamps such that the inner surfaces of the legs have approximately the same length as the distance between the legs. In order to simplify mounting and to provide for uniform force distribution during slip-on of the clamps, it is advantageous that the free ends of the legs have slanted portions at their inner surfaces with an opening angle that corresponds to the slant angle of the receiving surfaces.

It is expedient to provide a means for securing the clamps in a defined position so that the clamps in their slipped-on position are secured and cannot be displaced due to different expansions and shrinkages of the metals of the clamp resulting from heating and cooling. This can be achieved in a simple manner by providing the means for securing in the form of a spring bracket that exerts permanently a prestress onto the clamp. In the case in which only two clamps are provided, it is suggested that the oppositely arranged clamps are secured by a common spring bracket having free ends that are positioned in depressions of the clamps. The spring bracket is comprised preferably of a wire that at approximately half its length is provided with an expansion section.

As a further securing measure and an additional securing for the muffler it is suggested that its end which is opposite the flange connection is provided with auxiliary fastening means for connecting it to the crank case whereby the fastening means are preferably screws and support brackets. For reasons of weight reduction it is expedient for hand-held working tools that the motor block is manufactured of aluminum or an aluminum alloy. Accordingly, it is also favorable that the muffler is made of aluminum or an aluminum alloy. Due to the required force load it is suggested that the clamps be made of hardened steel.

DESCRIPTION OF PREFERRED EMBODIMENTS

The present invention will now be described in detail with the aid of several specific embodiments utilizing FIGS. 1 through 4.

FIG. 1 shows an internal combustion engine 1 for a hand-held working tool, for example, a motor chain saw with a crankcase 2 and a cylinder 3. The cylinder 3 has an outlet 4 for the combustion chamber 12. The outlet 4 is connected to an inlet opening (inlet) 6 of a muffler 5. The outlet 4 and the inlet 6 are connected by a flange connection 7 for connecting them in an outwardly sealing manner. Slip-on clamps 20 are provided for fastening which are positioned at least at two locations about the circumference of the flange connection 7. The muffler 5 is furthermore connected with its end 5' remote from the inlet 6 to the crank case 2. For this purpose, support brackets 10 are provided that are screwed with screws 9 to the muffler 5 and screws 11 to the crankcase 2. The crankcase 2, the cylinder 3, and the muffler 5 are made of cast aluminum; the clamps 20 are made of hardened steel.

Figure 2:
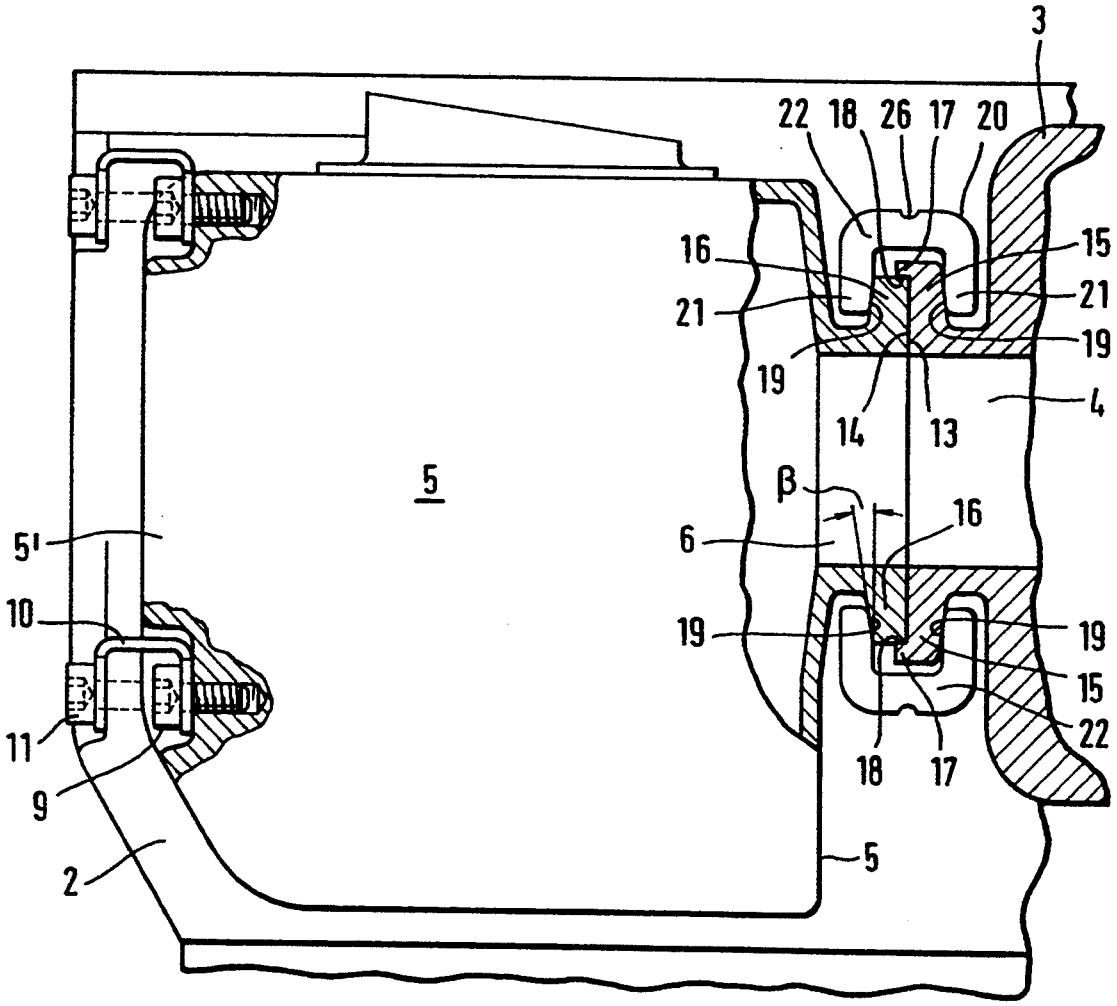
FIG. 2 shows a view in direction of arrow II in FIG. 1.

In FIG. 2 an enlarged view in the direction of arrow II in FIG. 1 is shown whereby the same reference numerals are used for same parts in FIGS. 1 and 2. At the outlet 4 of the cylinder 3 a radial flange surface 13 is provided at which rests a radial flange surface 14 of the inlet 6 of the muffler 5. The flange surface 13 of the cylinder is provided with radial projections 15 that are positioned at congruent projections 16 at the flange surface 14 of the muffler 5. At the radially outermost end of the radial projections 15 an axial step 17 is provided that engages over an edge 18 of the abutting radial projection 16. The radial projections 15 and 16 have receiving surfaces 19 for the slip-on clamps 20 which are U-shaped, i.e., the clamps 20 have two parallel extending legs 21 that are connected to one another by a stay 22 that extends at a right angle relative to the longitudinal direction of the legs 21. The receiving surfaces 19 for the legs 21 of the clamps 20 extend at an angle $\beta$ of 8° relative to the flange surface so that a self-locking connection is achieved by slipping on the clamps 20. The stay 22 of the clamps 20 has a depression 26 for receiving a securing device which will be explained infra. The end 5' of the muffler 5 which is remote from the flange connection 7 is provided with support brackets 10 that are screwed on by screws 9. The support brackets 10 are furthermore connected with screws 11 to the crankcase 2.

Figure 3:
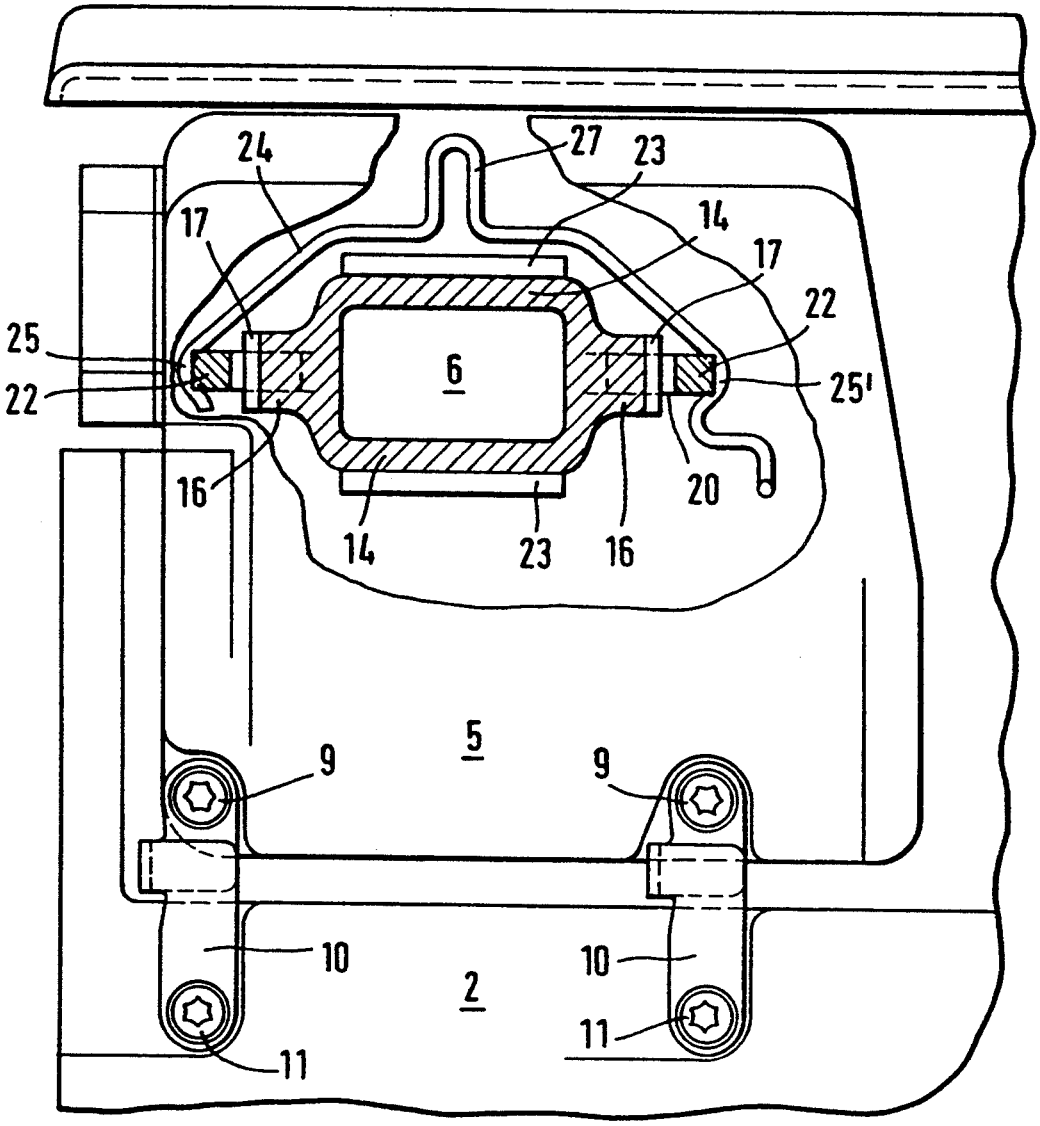
FIG. 3 shows a view along the line III in FIG. 1.

FIG. 3 shows a section along line III—III of FIG. 1. Same parts are identified with same reference numerals as in FIG. 1. At the lower portion of FIG. 3 the fastening of the muffler 5 with screws 9 and 11 and support brackets 10 at the crankcase 2 is shown. The upper half of FIG. 3 shows a section through the flange connection 7 in a plane of the radial projection 16 along the line III—III of FIG. 2. The radial projections 16 are engaged by steps 17. An equivalent measure is provided at the upper and lower end of the cross-section of the flanges connection. Here axial steps 23 are provided that engage over the flange surface 14. As can be seen from FIG. 3, the inlet opening 6 of the muffler 5 substantially has a rectangular shape. Clamps 20 are slipped on the projection 16 and are secured in their position by a spring bracket 24. The spring bracket 24 has two curved ends 25, 25' that rest in the depression 26 of the stays 22 and further has at approximately half its length between the radial ends 25 and 25' an expansion section 27. The spring bracket 24 compensates play between the projections 15, 16 and the clamps 20 resulting from different temperature coefficients.

Figure 4:
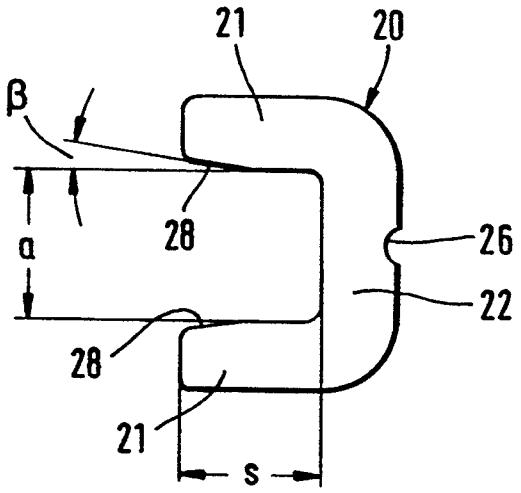
FIG. 4 shows an enlarged representation of a clamp.

FIG. 4 shows an enlarged representation of the U-shaped clamp 20 with parallel legs 21 and the stay 22 which at its outer side has a depression 26. The legs 21 have inner surfaces with free ends provided with a slant 28 having an angle $\beta$ relative to the longitudinal axis of the legs of 8°. The length of the legs 21 and the stay 22 is adjusted such that the length s of the inner surface of the legs 21 is approximately identical to the distance a between the legs 21.

The present invention is, of course, in no way restricted to the specific disclosure of the specification and drawings, but also encompasses any modifications within the scope of the appended claims.

What I claim is:

1. An internal combustion engine comprising:

a crankcase;

a cylinder with an outlet;

a muffler having an inlet and connected with said inlet to said outlet of said cylinder, said muffler formed as a unitary part;

said outlet having a first flange surface and said inlet having a second flange surface, said first flange surface and said second flange surface contacting one another so as to form a flange connection;

at least two slip-on clamps connected to a circumference of said flange connection;

said clamp having substantially the shape of a bracket with two legs extending in a same direction;

said legs having inner surfaces facing one another; and said flange connection having receiving surfaces for said legs wherein said inner surfaces of said legs cooperate with said receiving surfaces so as to force said first and said second flange surfaces against one another.

2. An internal combustion engine according to claim 1, wherein said receiving surfaces extend at a slant angle of less than 15° relative to said first and said second flange surfaces.

3. An internal combustion engine according to claim 2, wherein said slant angle is substantially 8°.

4. An internal combustion engine according to claim 1, wherein said receiving surfaces are formed by a radial collar at said outlet and a radial collar at said inlet.

5. An internal combustion engine according to claim 4, wherein one of said radial collars at said outlet and said inlet has an axial step and the other of said radial collars of said outlet and said inlet has an edge and wherein said step engages over said edge.

6. An internal combustion engine according to claim 1, wherein said receiving surfaces are in the form of radial projections of said first and said second flange surfaces, wherein said radial projections of said first flange surface are positioned congruent to said radial projections of said second flange surface.

7. An internal combustion engine according to claim 6, wherein one of said radial projections at said first and said second flange surfaces has an axial step and the other of said radial projections of said first and said second flange surfaces has an edge and wherein said step engages over said edge.

8. An internal combustion engine according to claim 1, wherein said at least two clamps are uniformly distributed over said circumference of said flange connection.

9. An internal combustion engine according to claim 1, wherein said legs extend parallel to one another and wherein said clamp has a stay connecting said legs, said stay extending perpendicular to said legs.

10. An internal combustion engine according to claim 9, wherein said inner surfaces of said legs at free ends of said legs have a slanted portion with an opening angle of less than 15° and wherein said receiving surfaces extend at a slant angle relative to said first and said second flange surfaces, said slant angle being identical to said opening angle.

11. An internal combustion engine according to claim 10, wherein said slant angle and said opening angle are substantially 8°.

12. An internal combustion engine according to claim 9, wherein a length of said inner surface of said legs is substantially identical to a distance between said legs.

13. An internal combustion engine according to claim 9, further comprising a means for securing said clamp in a defined position.

14. An internal combustion engine according to claim 13, wherein said means is a spring bracket that exerts a permanent prestress onto said clamp.

15. An internal combustion engine according to claim 14, wherein:

for two said clamps positioned diametrically opposite one another, said means is in the form of one common spring bracket;

said two clamps each have a depression in said stay; and said spring bracket has free ends that rest in said depression.

16. An internal combustion engine according to claim 15, wherein said spring bracket consists of a wire having at substantially half a length thereof an expansion section.

17. An internal combustion engine according to claim 1, wherein said muffler has an end remote from said flange connection and further comprises auxiliary fastening elements for connecting said end remote from said flange connection to said crankcase.

18. An internal combustion engine according to claim 17, wherein said fastening elements are screws and support brackets.

19. An internal combustion engine according to claim 1, wherein said cylinder and said muffler are made of a material selected from the group of aluminum and aluminum alloys and wherein said clamps are made of steel.

20. An internal combustion engine according to claim 19, wherein said clamps are made of hardened steel.

* * * * *